US007009342B2

(12) United States Patent
Minakov

(10) Patent No.: US 7,009,342 B2
(45) Date of Patent: Mar. 7, 2006

(54) PLASMA ELECTRON-EMITTING SOURCE

(76) Inventor: Valeriy Ivanovich Minakov, 1 Zborovskiy per., d.13, kv 72, 107076, Moskva (RU)

( * ) Notice: Subject to any disclaimer, the term of this patent is extended or adjusted under 35 U.S.C. 154(b) by 0 days.

(21) Appl. No.: 10/509,020

(22) PCT Filed: Mar. 7, 2003

(86) PCT No.: PCT/RU03/00084

§ 371 (c)(1),
(2), (4) Date: Sep. 23, 2004

(87) PCT Pub. No.: WO03/081965

PCT Pub. Date: Oct. 2, 2003

(65) Prior Publication Data

US 2005/0116653 A1 Jun. 2, 2005

(30) Foreign Application Priority Data

Mar. 26, 2002 (RU) ..... 2002107468

(51) Int. Cl.
*H01J 7/24* (2006.01)
*H01J 17/26* (2006.01)

(52) U.S. Cl. ..... 315/111.81; 313/231.01; 313/360.1

(58) Field of Classification Search ..... 315/111.21, 315/111.41, 111.81, 111.91; 313/231.01, 313/231.31, 362.1, 360.1; 250/423 R, 428, 250/432 R See application file for complete search history.

(56) References Cited

U.S. PATENT DOCUMENTS

| | | | | |
|---|---|---|---|---|
| 4,782,235 | A * | 11/1988 | Lejeune et al. | 250/423 R |
| 4,862,032 | A | 8/1989 | Kaufman et al. | 313/361.1 |
| 5,041,732 | A * | 8/1991 | Saito et al. | 250/396 ML |
| 5,646,476 | A * | 7/1997 | Aston | 315/111.81 |
| 5,763,989 | A | 6/1998 | Kaufman | 313/359.1 |
| 6,750,600 | B1 * | 6/2004 | Kaufman et al. | 313/361.1 |
| 2003/0161969 | A1 * | 8/2003 | Hilliard | 427/571 |

* cited by examiner

*Primary Examiner*—Thuy Vinh Tran
(74) *Attorney, Agent, or Firm*—Donn K. Harms

(57) ABSTRACT

The invention relates to the field of gaseous-discharge high-vacuum apparatuses. The engineering effect attainable thereby consists in improving the efficiency of extracting the electron beam as well as the gas and power efficiency. The disclosed plasma electron source comprises inner and outer pole pieces made as bodies of revolution having central holes, with a magentomotive force source arranged between them, and comprises also, placed in a sealed housing, an arc diaphragmed hollow cathode with a gas feed device as well as, installed between and in line with the coaxial outlets of the cathode and housing, intermediate and main anodes made as bodies of revolution having central holes. The intermediate anode, the inner pole piece, an annular header, the main anode and the outer pole piece are installed successively between the outlets of the cathode and housing. The main anode is made of a magneto-weak material and positioned so that at least 30% of the magnetic flux created in the space between the pole pieces flows through its hole. The inner and outer pole pieces are electrically connected with the cathode.

8 Claims, 2 Drawing Sheets

PLASMA ELECTRON-EMITTING SOURCE

Figure 1:
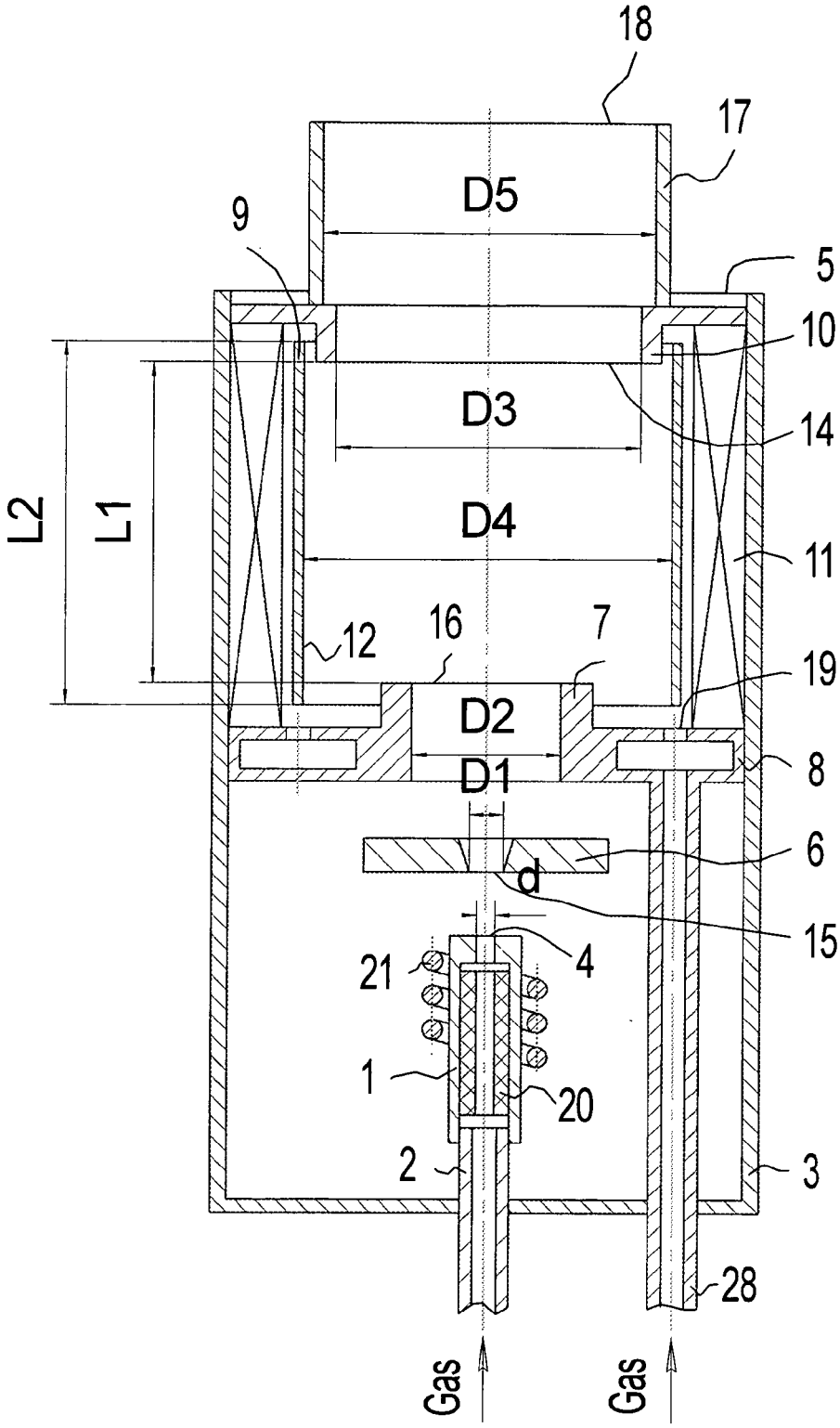

This Application is a national stage application filing under 35 U S.C. 371 of International Application No. PCT/RU03/00084 filed Mar. 7, 2003, which claims priority from Russian Federation Application No. 2002107468 filed Mar. 26, 2002.

FIELD OF APPLICATION

The invention relates to the field of gaseous-discharge high-vacuum (P<0.1 Pa) apparatuses and is designed for operation as a cathode of powerful transmitting valves (for instance, a cathode of an SHF oscillator) as well as in ion-beam sources and particularly in such space electric rocket engines as a plasma-ion engine (PIE) (a cathode/neutralizer of a PIE) and a stationary plasma engine (SPE) (a cathode/compensator of an SPE).

STATE OF THE ART

A cathode unit is known to comprise, enclosed in a sealed housing, an arc diaphragmed hollow cathode with a gas feed device, and an intermediate anode [1].

An arc discharge between such cathode and an external anode (when the cathode works in a PIE, the external anode comprises ion-beam plasma) is initiated while a working medium (inert gases, mercury or cesium vapors) is pumped through the cathode cavity at a constant flow rate. Long service life and low level of power expenditures have predetermined the use of the above apparatus as a traditional and practically sole type of electron source both for the Hallian engine (SPE) and for the PIE.

Along with this, the use of such cathode unit in the Hallian engine (SPE) restricts substantially the opportunities for improving the total propulsion efficiency of the engine. The inconsistency peculiar to the processes of generating charged particles in the discharge region at the cathode leads to an unfavorable distribution of the potential within the anode-cathode space, to an unproductive increase in the level of power expenditures and to an unreasonably high flow rate of the working medium flowing through the cathode cavity. The above-mentioned disadvantages caused by the low ionization efficiency of neutral atoms in the discharge column at low flow rates and a low temperature of electrons have an unfavorable effect on the competitiveness of the Hallian engine (SPE), this being reflected most prominently in the promising region of low thrusts (F<30 mN).

Similar disadvantages, although to a lesser extent, are intrinsic also in the cathode/neutralizer of the PIE.

The low level of power expenditures in combination with the possibility of obtaining a stationary electron beam with substantial currents (I>1 A) and high current densities draw attention to the prospects of using the arc diaphragmed hollow cathode in powerful electromagnetic oscillators of various types.

A plasma electron source (PELS) is known which is based on an inverted duoplasmatron with a hollow cathode arc [2].

Such source comprises, enclosed in a sealed housing, an arc diaphragmed hollow cathode with a gas feed device, and intermediate and main annular anodes mounted between and in line with the outlets of the cathode and housing as well as inner and outer annular pole pieces, with a magnetomotive force source arranged between them. Structurally, the outer pole piece is integral with the main anode, and the inner pole piece is integral with the intermediate anode. Thus, the pole pieces are respectively at potentials of the anodes they are integral with.

The discharge in this source is contragened by an opening in the intermediate anode and by a powerful nonuniform magnetic field in the space between the anodes where the maximum degree of gas ionization is reached. Electrons are extracted from the plasma thus formed through a hole in the main anode by means of a system of outer electrodes. Such PELS allows obtaining a stationary electron beam with substantial currents (I>1 A) and high current densities. A minimum gas flow rate in the PELS under discussion is lower than in a traditional cathode unit; however, a high level of specific power expenditures (in the order of 1 kWt/A) and a low efficiency of extracting the electron beam eliminate the possibility of using it as a cathode/compensator of the Hallian engine (SPE) and a cathode/neutralizer of the PIE as well as limit its applicability in transmitting valves.

SUBSTANCE OF THE INVENTION

The problem, which is to be overcome by the present invention, consists in improving the efficiency of extracting the electron beam as well as the gas and power efficiency.

The problem thus aimed at has been overcome owing to that, in a plasma electron source comprising inner and outer pole pieces made as bodies of revolution having central holes, with a magnetomotive force source arranged between them, and comprising also, placed in a sealed housing, an arc diaphragmed hollow cathode with a gas feed device, and intermediate and main anodes made as bodies of revolution having central holes, the intermediate anode, the inner pole piece, the main anode and the outer pole piece are installed successively between and in line with the outlets of the cathode and housing. The main anode is made of a magneto-weak material and positioned so that at least 30% of the magnetic flux created in the space between the pole pieces flows through its hole. The inner and outer pole pieces are electrically connected with the cathode and have a potential practically equal to the potential of the cathode. In a general case, the plasma source is provided with an annular header connected to a supplementary gas feed device. The annular header is provided with holes to supply gas to the space between the pole pieces beyond the zone located between said pole pieces and limited by the end faces of the pole pieces and by the internal surface of the anode.

LIST OF DRAWINGS

Figure 2:
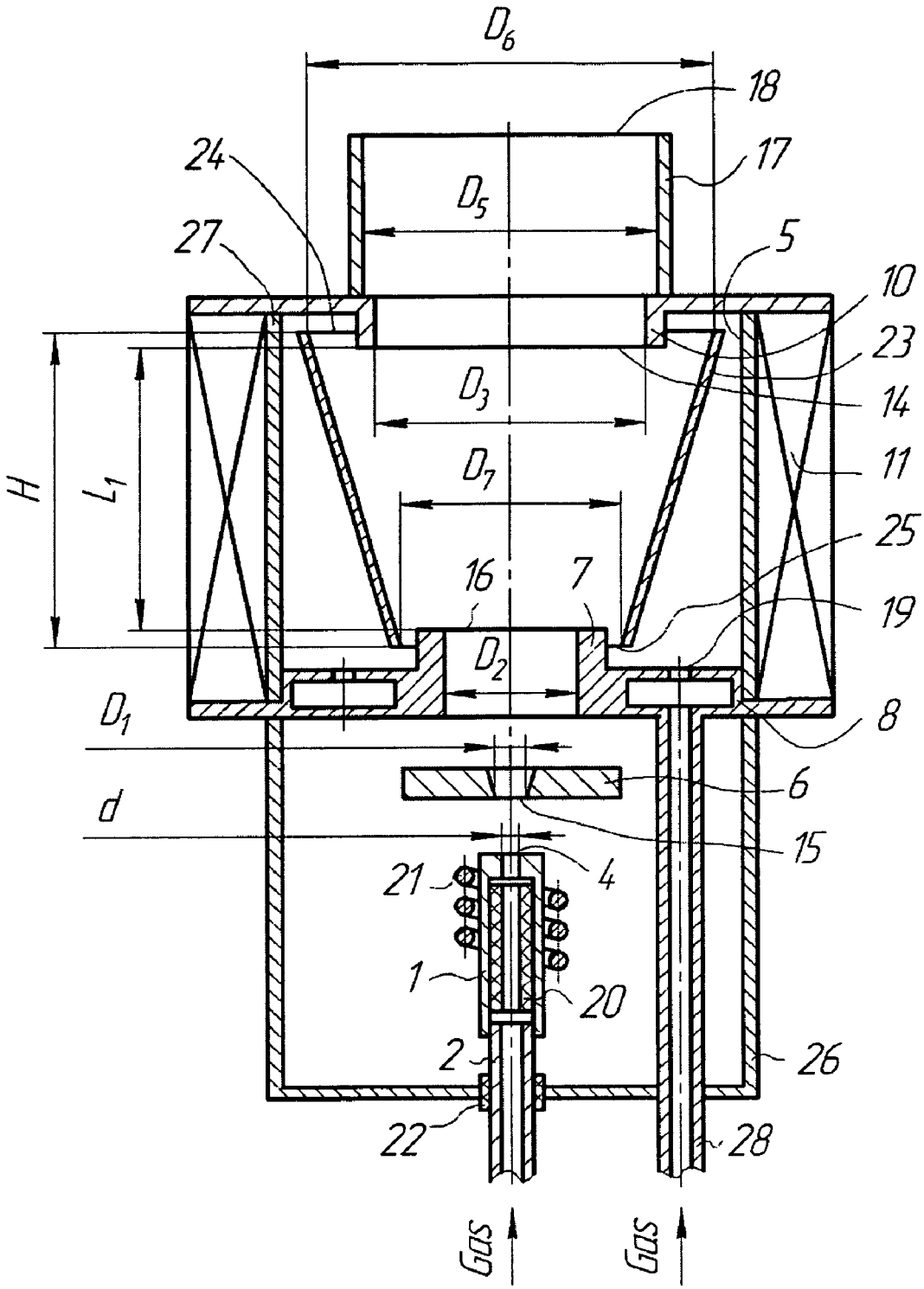

The invention will now be described in detail with reference to the accompanying drawings where FIGS. 1 and 2 show embodiments of the PELS.

DESCRIPTION OF THE EMBODIMENTS

The claimed PELS having a function of a cathode for a gaseous discharge apparatus comprises an arc diaphragmed hollow cathode (1) provided with a gas feed device (2) and arranged in a sealed housing (3)(FIG. 1) or (26) (27) (FIG. 2) so that the axes of the outlets of a cathode (4) and a housing (5) coincide with one another. In between the outlets of the arc hollow cathode (4) and of the housing (5) and in line therewith, there are installed successively an annular intermediate anode (6), an inner pole piece (7), an annular header (8) with a supplementary gas feed device (28), and a main anode (9) (23) and an outer pole piece (10). (In special embodiments of the claimed PELS, there can be no annular header with a supplementary gas feed device.) The inner (7) and outer (10) pole pieces are electrically connected (by short-circuiting or by way of completing the circuit through the gas discharge plasma) to the cathode (1), thus being practically at the same potential with the latter. The main anode (9) (FIG. 1) can be made as a hollow cylinder whose inside diameter $D_4$ (12) and length $L_2$ exceed the minimum diameter $D_3$ of the hole in the outer pole piece (10) by as much as 1 to 1.6 times. In another embodiment, the main anode (23) (FIG. 2) is made as a hollow truncated cone whose smaller base faces the inner pole piece (7). In this case, the inside diameter $D_6$ of the larger base (24) and the height H of the truncated cone are in the following ratios to the minimum diameter $D_3$ of the hole (14) in the outer pole piece (10): $D_6:D_3=1.3\pm0.3$, and $H:D_3=1.3\pm0.3$, respectively, the inside diameter $D_7$ of the smaller base (25) being in the following ratio to the minimum diameter $D_2$ of the hole (16) in the inner pole piece (7): $D_7:D_2=1.5\pm0.5$.

In all the embodiments of the main anode, the magnetic flux flowing through the cavity of the main anode without any contact with its internal surface amounts to at least 30% of the magnetic flux created in the space between the pole pieces. The main anode being made of a magneto-weak material allows practically to maintain the required distribution configuration of the magnetic induction vector in the space between the pole pieces irrespective of the geometrical parameters of the main anode.

The minimum diameters of the holes, d—in the cathode (1) (4), $D_1$—in the intermediate anode (6) (15), $D_2$—in the inner pole piece (7) (16), and $D_3$—in the outer pole piece (10) (14), respectively, are in the following ratio to each other: $d:D_1:D_2:D_3=1:10k:50k:100k$, where $k=1\pm0,5$; and the ratio of the gap $L_1$ between the pole pieces (7) (10) to the minimum diameter $D_3$ of the hole (14) in the outer pole piece (10) is equal to $L_1:D_3=1\pm0.4$. The gaps between the cathode (1) and the intermediate anode (6) as well as between the intermediate anode (6) and the inner pole piece (7) are commensurable with the minimum diameter $D_1$ of the hole (15) in the intermediate anode (6).

The outlets (19) of the annular header (8) are positioned inside the sealed housing (3) (27) (FIGS. 1 and 2) between the inner (7) and outer (10) pole pieces outside the intensive ionization zone located between the pole pieces (7) (10) and limited by the surfaces of the pole pieces (7) (10) and of the main anode (9) (23) that face the above-mentioned zone.

Immediately behind the cut of the outer pole piece (10) and adjacent thereto, there can be mounted an expander (17) whose minimum inside diameter $D_5$ (18) exceeds the minimum diameter $D_3$ of the hole (14) in the outer pole piece (1) by as much as 1 to 1.6 times.

The magnetomotive force source can be mounted beyond the sealed housing (FIG. 2). In this embodiment, the outer edges of the pole pieces (7) (10) reach beyond the sealed housing consisting of two parts (26) (27), wherein at least the part (27) of the housing that is between the pole pieces (7) (10) is made of a magneto-weak material and, besides, the condition of air-tightness in the joints of the parts (26) (27) of the housing with the pole pieces is thus complied with. In case if the magnetomotive force source is made as a hollow cylinder of a hard magnetic material, the magnetomotive force source assumes the properties of a sealing member and can become a part of the sealed housing.

The anodes (6) (9) (23) are electrically connected to the positive terminals of respective electric power sources whose negative terminals are connected to the cathode (1), the intermediate anode (6) being connected to its power source through a limiting (ballast) resistor or the like. A starting heater (21) ensures the required temperature of the arc diaphragmed hollow cathode (1) and that of an insert (20) made of a material having a low work function at the moment of discharge initiation. An insulator (22) (FIG. 2) allows to maintain the sealed housing (26) (27) and the structural members short-circuited thereto (including also the pole pieces (7) (10)) at a floating potential which is practically equal to the potential of the cathode (1) and at which the sum total of all the currents falling to these members is equal to zero.

Gas can be supplied to the PELS over a single common pipeline. In this embodiment, the flow rates are distributed between the cathode and the header, as required, by means a jet mounted at the inlet to the header. The functions of the jet can be carried out by a rod pressed into a tube, and the external cylindrical surface of which is provided with a helical groove. The gas-dynamic conductivity of such jet is determined by the geometrical parameters of the helical groove.

In the claimed apparatus, the discharge is contragened immediately at the cut of the hole (4) in the cathode (1) when predetermining the flow rate of gas passing through the cavity of the cathode (1). The electrons emitted from the intracathodic plasma are accelerated in the jump of potential at the cathode resulting from contragening thereof up to the energy of about 20 to 30 eV, thus making up a group of "primary" high-energy electrons, and come into crossed electric and magnetic fields in the interior space of the main anode (9) (23) between the pole pieces (7) (10). The reflecting discharge plasma emerging in this space (electrons are moving mainly along the lines of force of the magnetic field between the pole pieces which are at the cathode potential, to be "reflected" therefrom with a simultaneous drift in the azimuth direction) ionizes efficiently the atoms of gas. The excitation losses are relatively low, insofar as the "secondary" electrons liberated during ionization would possess an average energy in the order of 10 to 15 eV. Thus, a zone of intensive ionization is created in the cavity of the main electrode (9) (23), this zone being delimited by the intersection where the surface of revolution defined by the lines of force of the magnetic field that are tangential to the internal surface of the main anode (9) (23) are crossing the pole pieces (7) (10).

The required level of pressure is maintained in this zone by means of supplying thereto a predetermined ratio of gas flow rates through the cavity of the cathode (1) and through the outlets (19) of the header (8) of a supplementary feeding system. A reduction in the flow rate of the gas flowing through the header (8) down to a complete stoppage of gas supply will, in a general case, lead to a decreased efficiency of electron extraction, a reduction in the current extracted to the outer anode and to a less smooth burning of discharge. Nevertheless, within a narrow region of varying the relationships between the geometrical parameters of the PELS, the magnitude of magnetic induction, the flow rate of the gas passing through the cathode and the current extracted to the outer anode, it is possible for the discharge to exist without feeding of gas to the header, and it is, therefore, possible, in a special particular case, to refuse from using the header of a supplementary feeding system.

At optimum modes, the potential of the electric field is distributed in the cavity of the main anode (9) (23) in such a manner that most of the ions produced at the periphery of the zone of intensive ionization are accelerated up to the energies in the order of 10 to 30 eV in the direction to the discharge axis and to the outlet (14) in the outer pole piece (10). Outside the PELS, they form an ion beam, i.e. a ion "skeleton" of the discharge column, thereby creating favorable conditions for completing the circuit of electron current to the outer anode, while the current delivered to the main anode (9) (23) is limited by the magnetic field. At these modes of burning of the discharge, the current delivered to the outer anode is 3 to 5 times as large as the current delivered to the main anode (9) (23) at practically the same potentials of the above-mentioned anodes. The discharge power released in the circuit of the intermediate anode (6) does not exceed 20% of the power released in the circuit of the main anode (9) (23).

The ion flow moving from the zone of intensive ionization towards the arc hollow cathode (1) maintains the required values of concentration of charged particles, potential jump at the cathode and temperature of the cathode when in a stationary mode of operation. Improved conductivity of the plasma in the space behind the PELS and up to the zone of contact with the outer anode is determined by the high temperature of electrons as compared against the temperature of electrons in the plasma created in the discharge with a traditional cathode unit.

The opportunity of controlling the values of concentration and energy as well as the intensity and direction of the flow of the charged particles of both signs, which is provided by the disclosed technical solution, predetermines the efficiency of purposeful use of the majority of these values and, in the final analysis, such new parameters of the entire gaseous discharge apparatus as a whole, which are more preferable.

Such implementation of the processes allows to obtain a reasonable nonmonotonic distribution of the plasma potential, improve its conductivity due to an rise in the temperature of electrons throughout the entire space between the hollow cathode and the anode, and improve thereby substantially the characteristics of the gaseous discharge apparatus.

Use made of the claimed plasma electron source as a component (i.e., a cathode) of an electromagnetic oscillator allows:

1) to reduce substantially power expenditures and respectively the heat release in the cathode region of the discharge;

2) to obtain higher values of both the current and the density of current in a stationary electron beam;

3) to improve substantially both the efficiency of extracting an electron beam and the energy efficiency; and 4) to improve controllability and smoothness of the discharge at a low level of pressure (P<0.01 Pa) within the space where the electron beam is distributed.

Use made of the claimed plasma electron source as a component (i.e., a cathode/neutralizer) of a PIE allows:

1) to raise the propulsion efficiency of the engine as a result of creating additional thrust by the cathode/neutralizer, with a reduction in both the energy losses and gas flow rate;

2) to extend the service life of the accelerating electrode of the ionic-optical system due to a reduction in the difference of potentials between the accelerating electrode and the plasma in the space of neutralizing the ion beam; and 3) to improve controllability and smoothness of the discharge at a low level of pressure (P<0.01 Pa) within the space where the ion-electron beams are distributed that are created by an electric rocket engine and a plasma electron source.

Use made of the claimed plasma electron source as a component (i.e., a cathode/compensator of a Hallian engine (SPE) allows:

1) to improve both the thrust and the propulsion efficiency of the engine due to a reduction in unproductive losses of energy within the space from the cathode of the plasma electron source to the anode of the Hallian engine (SPE);

2) to improve both the thrust and the propulsion efficiency of the engine as a result of creating additional thrust by the plasma electron source, with a reduction in the gas flow rate;

3) to control efficiently both the value of the floating potential of the cathode/compensator and the distribution of the potentials within the space where the beams created by the anode of the Hallian engine (SPE) and by the plasma electron source interact with one another;

4) to improve controllability and smoothness of the discharge at a low level of pressure (P<0.01 Pa) within the space where the ion-electron beams created by the Hallian engine (SPE) and by the plasma electron source interact with one another; and 5) to extend the service life of the Hallian engine due to a change in both the location and the length of the ion generation and acceleration zone.

Thus, by means of the claimed plasma electron source, the self-coordinating problem of implementing efficiently a discharge of required parameters in various gaseous discharge apparatuses with a low level of gas flow rate, low energy expenditures and a high efficiency has been successfully resolved. The solution of this problem gave rise to such new properties as obtaining additional thrust and extending the service life when operated in electric rocket engines as well as to the opportunity of controlling efficiently both the magnitude of the floating potential of the cathode/compensator and the distribution of the potential within the space where the ion-electron beams created by the electric rocket engine and by the plasma electron source interact with one another.

LITERATURE

1. A. T. Forrester, Intensive Ion Beams, Moscow, Mir Publishers, 1992, p. 191.
2. A. S. Roberts, Jr., James L. Cox, Jr., and Willard N. Bennett. Electron Beams From Duoplasmatron Using a Hollow Cathode Arc as Electron Source. J. Appl. Phys., V. 37, No. 8 (1966), p. 3231.
3. U. T. Cranedel, Plasma Electron Sources, Moscow, Atomizdat Publishers, 1977, pp. 53–54.

What is claimed is:

1. A plasma electron source having a function of a cathode for a gaseous discharge apparatus, comprising inner and outer pole pieces made as bodies of revolution having central holes, with a magnetomotive force source arranged between them, and comprising also, placed in a sealed housing, an arc diaphragmed hollow cathode with a gas feed device as well as, installed between coaxial outlets of the cathode and housing, intermediate and main anodes made as bodies of revolution having central holes, characterized in that the intermediate anode, the inner pole piece, the main anode and the outer pole piece are installed successively between and in line with the outlets of the cathode and housing; in that the main anode is made of a magneto-weak material and positioned so that at least 30% of the magnetic flux created in a space between the pole pieces flows through its hole; and in that the inner and outer pole pieces are electrically connected with the cathode.

2. The electron source according to claim 1 characterized in that it is provided with an annular header connected to a supplementary gas feed device; and in that the header is provided with holes to supply gas to the space between the pole pieces.

3. The electron source according to claims 1 or 2 characterized in that minimum diameters of the holes, d—in the cathode, $D_1$—in the intermediate anode, $D_2$—in the inner pole piece, and $D_3$—in the outer pole piece, respectively, are related to each other by the following ratio: $d:D_1:D_2:D_3=1:10k:50k:100k$, where $k=1\pm0.5$; and in that a ratio of a gap $L_1$ between the pole pieces to the minimum diameter $D_3$ of the hole in the outer pole piece is equal to $L_1:D_3=1\pm0.4$.

4. The electron source according to claims 1 or 2 characterized in that the main anode is made as a hollow cylinder whose inside diameter $D_4$ and length $L_2$ are in the following ratios to the minimum diameter $D_3$ of the hole in the outer pole piece: $D_4:D_3=1.3\pm0.3$, and $L_2:D_3=1.3\pm0.3$, respectively.

5. The electron source according to claims 1 or 2 characterized in that the main anode is made as a hollow truncated cone whose smaller base faces the inner pole piece, an inside diameter $D_6$ of a larger base and a height H of the cone are in the following ratios to a minimum diameter $D_3$ of the hole in the outer pole piece: $D_6:D_3=1.3\pm0.3$, and $H:D_3=1.3\pm0.3$, respectively, and an inside diameter $D_7$ of the smaller base is in the following ratio to a minimum diameter $D_2$ of the hole in the inner pole piece: $D_7:D_2=1.5\pm0.5$.

6. The electron source according to claims 1 or 2 characterized in that the magnetomotive force source is mounted beyond the sealed housing made of a magneto-weak material.

7. The electron source according to claims 1 or 2 characterized in that the magnetomotive force source is made of a hard magnetic material as a hollow cylinder and is a component of the sealed housing.

8. The electron source according to claims 1 or 2 characterized in that mounted on the external side of the outer pole piece is an expander whose minimum inside diameter $D_5$ exceeds a minimum diameter $D_3$ of the hole in the outer pole piece by as much as 1 to 1.6 times.

* * * * *